US007484667B2

(12) United States Patent
Speich

(10) Patent No.: US 7,484,667 B2
(45) Date of Patent: Feb. 3, 2009

(54) METHOD AND INSTALLATION FOR PRODUCING PATTERNED TEXTILE LABELS

(75) Inventor: Francisco Speich, Gipf-Oberfrick (CH)

(73) Assignee: Brevitex Etablissement Pour L'Exploitation De Brevets Textiles (LI)

( * ) Notice: Subject to any disclaimer, the term of this patent is extended or adjusted under 35 U.S.C. 154(b) by 1077 days.

(21) Appl. No.: 10/481,550

(22) PCT Filed: Jun. 18, 2002

(86) PCT No.: PCT/CH02/00330

§ 371 (c)(1),
(2), (4) Date: Apr. 9, 2004

(87) PCT Pub. No.: WO03/000974

PCT Pub. Date: Jan. 3, 2003

(65) Prior Publication Data

US 2006/0247819 A1 Nov. 2, 2006

(30) Foreign Application Priority Data

Jun. 22, 2001 (CH) ..... 1145/01

(51) Int. Cl.
*G06K 19/06* (2006.01)

(52) U.S. Cl. ..... 235/494; 235/488

(58) Field of Classification Search ..... 235/494, 235/451, 492, 493, 488; 283/86, 109; 428/343, 428/354, 40, 34.1
See application file for complete search history.

(56) References Cited

U.S. PATENT DOCUMENTS

| | | | | |
|---|---|---|---|---|
| 4,766,301 | A | 8/1988 | Evers | |
| 6,241,289 | B1 * | 6/2001 | Kulper et al. | 283/86 |
| 2003/0148055 | A1 * | 8/2003 | Scheubner | 428/40.1 |
| 2004/0244865 | A1 * | 12/2004 | Jung et al. | 139/426 R |
| 2005/0248649 | A1 * | 11/2005 | Farrell et al. | 347/216 |
| 2006/0247819 | A1 * | 11/2006 | Speich | 700/130 |
| 2006/0263595 | A1 * | 11/2006 | Scheubner | 428/343 |

FOREIGN PATENT DOCUMENTS

| | | |
|---|---|---|
| DE | 36 27 315 A | 2/1987 |
| DE | 43 41 532 C | 4/1995 |
| EP | 1 085 114 A | 3/2001 |
| WO | WO 00 73 559 A | 12/2000 |

* cited by examiner

*Primary Examiner*—Thien M Le
(74) *Attorney, Agent, or Firm*—George Pappas

(57) ABSTRACT

The invention relates to a method for producing patterned textile labels during which a production machine, which is controlled by a pattern device (22), provides labels (E.sub.1 to E.sub.N)with a pattern (M), which is the same for all labels, and with pattern sections (T.sub. 1 to T.sub.N) that are different from one another. In order to improve production, a virtual label (V) is created from N individual labels E.sub.1 to E.sub-.N)which are distributed over the width (B) and the length (L) of the virtual label (V) and which have N individual pattern sections (T.sub.1 to T.sub.N) that are different from one another, and then virtual label (V) is then divided into individual labels (E.sub.1 to E.sub.N).

35 Claims, 3 Drawing Sheets

METHOD AND INSTALLATION FOR PRODUCING PATTERNED TEXTILE LABELS

TECHNICAL FIELD

The invention relates to a method for producing patterned textile labels and to an installation for carrying out the method.

BACKGROUND

A method and in installation of the type initially mentioned are known, for example, from DE 36 27 315 A or WO 00/73 559. The labels produced there have, in addition to a regular pattern, individual pattern parts for which spaces provided with basic designs of specific configuration are reserved in a specific region (space holders). Design pattern parts, that is to say finished design parts, are inserted into the space regions automatically from an electronic store. These pattern parts may be variable. The finished design parts already possess all the information for controlling the production machine, for example a Jacquard weaving machine.

It is relatively difficult, however, in the case of a continuous production of labels, to provide each label with a markedly different individual pattern part. At all events, the spaces where variable data can be inserted are fixed and limited. A further difficulty is that the pattern parts have to be prefabricated, therefore it is not possible in a simple way to change, for example, the width, the length or another parameter. There has to be a fundamental redesign, thus incurring high costs. Furthermore, the transitions from one pattern part to another must be coordinated exactly with one another in terms of weave, which is difficult to implement. Moreover, there is no safety against wrongly assigning an individual pattern part many times.

SUMMARY OF THE INVENTION

The object of the invention is to improve a method and an installation of the type initially mentioned in such a way that labels having pattern parts individually different from one another can be produced continuously in a simple and reliable way.

Since the virtual label consisting of N individual labels distributed over the width and length of the virtual label and having a pattern and N individual pattern parts different from label to label is produced, and the virtual label thus produced is subdivided into N individual labels, this ensures that the individual labels produced in the batch size N are also actually different from one another.

The width of the virtual label corresponds to the number of warp threads used in a production machine, for example a weaving machine. N may be of any desired size. Preferably, a length is used which corresponds to the length of a cloth web capable of being wound on a winding beam. The batch size N may also depend on the labels capable of being packaged in a packaging unit.

The labels may in each case be provided with at least one second pattern part which may be a continuous numbering which may be distributed continuously, preferably in the longitudinal direction of the virtual label, in rows lying next to one another. The individual pattern parts may also be a bar code or counterfeit-proof additional code which can be generated by a random generator. Pattern parts may also be various graphic figures, such as images, logos or the like. Other individual pattern parts may also be envisaged, such as various forenames and/or family names. The individual pattern part may also consist of a series of objects, plants, animals or the like.

The virtual label is provided at the start and at the end with identifying information, in order, for example, to identify or inscribe a batch size. Pattern-free intermediate zones for subdividing the virtual labeling to individual labels or label webs are provided between the individual labels in the virtual label V in the longitudinal direction and/or in the width direction. These intermediate zones may be formed by a pattern-free ground fabric part. The intermediate zones may also be formed in the longitudinal direction by fabric-free zones, in that the virtual label is produced in longitudinal strips distributed over the width.

The virtual label is first produced in the design mode and only then converted by means of a converter into a pattern mode capable of being processed by the production machine. These individual pattern parts may be generated manually, semiautomatically and fully automatically. Particularly in the latter case, it is advantageous if a computer-controlled pattern device with a CAD system having design software and with at least one generator for generating the individual pattern parts is used for the design mode.

The pattern device may be arranged independently of the production machine, and data transfer to the production machine may take place by means of a data line or preferably by means of a data carrier. In this case, the pattern device may preferably be arranged advantageously even independently of the user of the production machine, on the premises of the manufacturer. The person operating the production machine can then transmit the desired pattern and the desired individual pattern parts as a model to the operator of the pattern device who then sets up the necessary control program, what is known as the master program, the control signals for the production machine, then determines returns it to the user for controlling the production machine.

The production machine may be a printing machine, on which a textile web is printed with the virtual label. It is appreciably more advantageous to use a Jacquard weaving machine for producing the virtual label. The virtual label may be woven with a selvedge on a multi-section Jacquard needle ribbon weaving machine without fabric-width repeat repetition. Higher performances can be achieved by means of a method when the virtual label is produced on a Jacquard broad-weaving machine without fabric-width repeat repetition.

The virtual label, then, may be produced continuously on such a production machine as a ribbon or broad web and subdivided into individual labels, independent of the production machine, and at all events also folded to the final shape in a folding machine. However, it is also possible for the virtual label to be cut in the longitudinal and/or width direction during production on the production machine.

It is advantageous if the virtual label is produced for a production machine which has a production counter, in order to detect the number of labels produced for the most diverse possible applications, such as a check of the batch size produced for a customer for the labels, and/or for license accounting for the machine and/or software manufacturer.

BRIEF DESCRIPTION OF THE DRAWINGS

Exemplary embodiments of the invention are designed in more detail below with reference to the drawings in which.

DETAILED DESCRIPTION OF THE INVENTION

Figure 1:
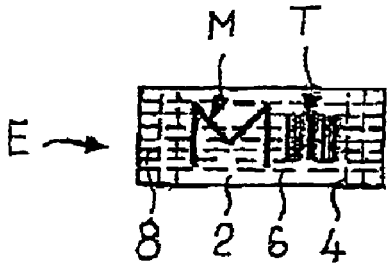
FIG. 1 shows a plan view of an individual label.

FIG. 1 shows a label E consisting of a ground fabric 2 which is produced from ground warp threads 4 and ground weft threads 6. Figure weft threads 8 serve for generating a pattern M and individual pattern parts T, the latter being different from one another from label to label.

Figure 2:
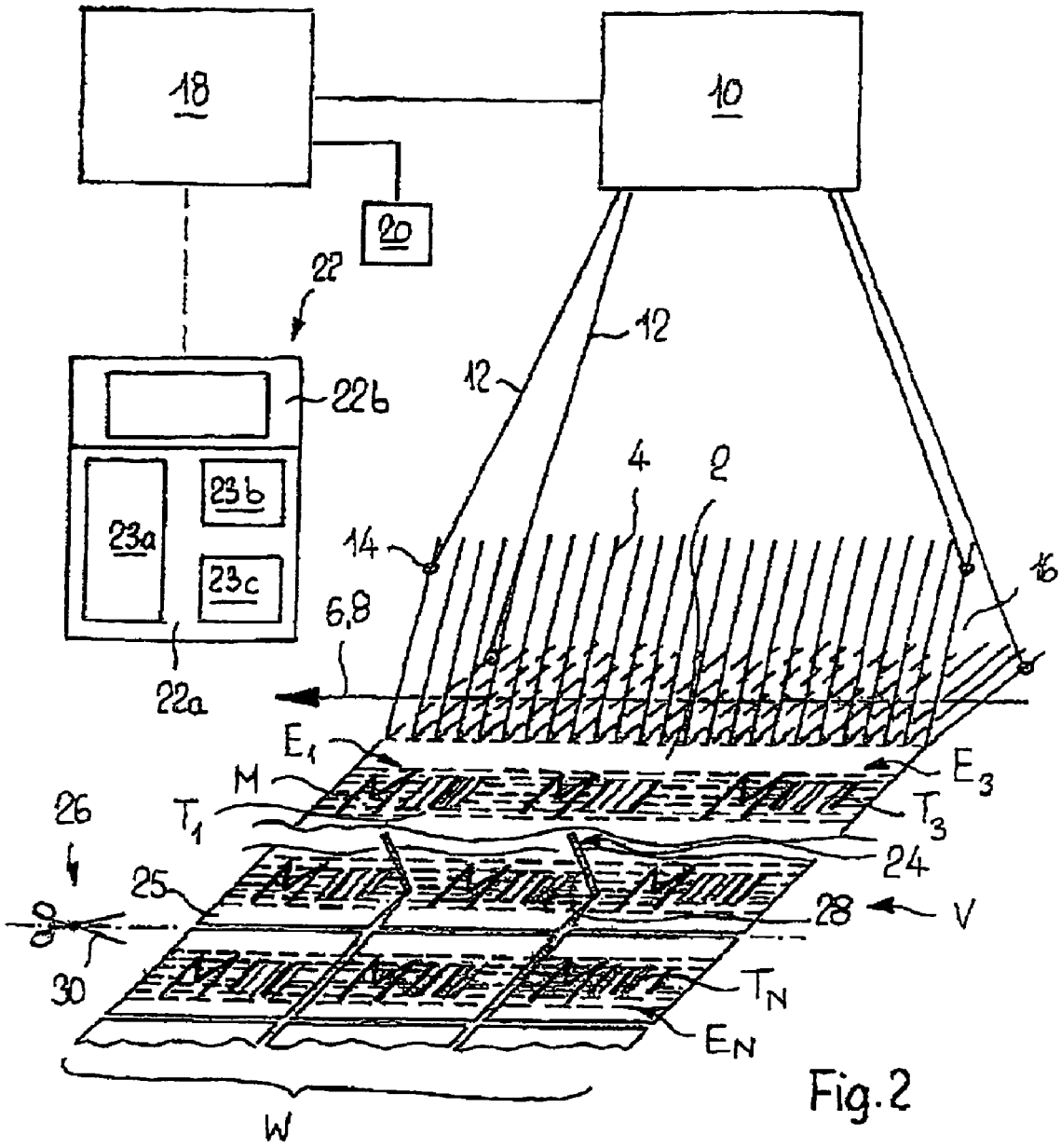
FIG. 2 shows a diagrammatic illustration of a Jacquard broad-weaving machine, partially in a graphic illustration and partially as a block diagram.

FIG. 2 shows a diagram of a preferred production machine, preferably designed as a Jacquard broad-weaving machine, with a Jacquard device 10 which, via heddles and heddle eyes 14, opens the warp threads 4 to a shed 16, into which, on the one hand, the ground weft threads 6 and, on the other hand, the figure weft threads 8 are shut and tied off with the ground fabric 2 and also the patterns M and the pattern parts T.

The Jacquard broad-weaving machine contains a control device 18 which at all events has a production counter 20. The control device 18 is fed by a pattern device 22 which either may be connected directly to the control device or may be arranged separately from the Jacquard broad-weaving machine, for example in a pattern center. In the latter case, the data of the pattern device 22 may be transmitted via a data carrier, for example a diskette, or via a data line, for example a CAM network.

The pattern device 22 contains a design part 22*a* with a CAD system 23*a*, in which a desired pattern is prepared, furthermore first control means 23*b* and, if appropriate, further control means 23*c* which are, for example, generators, in order to prepare one or more individual pattern parts T. Furthermore, the pattern device comprises a converter 22*b* (design device) which converts the virtual label V prepared in a design part 22*a* into a machine-readable form which can be processed by the control device 18 of the production machine 10, in the present example the Jacquard device of a weaving machine. The control means 23*b*, 23*c* may be manually actuated devices, semiautomatic devices or fully automatic devices, the latter, in particular, containing corresponding software.

By means of the control program generated in the pattern device 22, that is known as the master program, the Jacquard broad-weaving machine can be controlled and the cloth web W indicated in FIG. 2 can be produced. This cloth web has woven in it individual labels $E_1$ to $E_3$ which lie next to one another and have in each case a common pattern M and pattern parts $T_1$ to $T_3$ individual from one another. Such individual rows of labels are lined up with another in the warp direction. A virtual label V determined by the master program is obtained, containing N individual labels E, which have pattern parts $T_1$ to $T_N$ which are, however, different from one another. The labels are separated in the width direction through intermediate zones 25 which consist of ground fabric. The virtual label V thus produced may be subdivided in the longitudinal direction, by means of a first severing device 24, into individual strips which are then cut into individual labels E along the intermediate zone 25 by means of a second severing device 28. In the example shown, the first severing device 24 is made of thermal cutting elements 28 which may consist of a resistance wire or of an ultrasonic device. The second severing device 26 may be designed in a similar way to the first severing device 24. In the example shown, indicated by the scissors 30 that the second severing device 26 operates mechanically.

Figure 3:
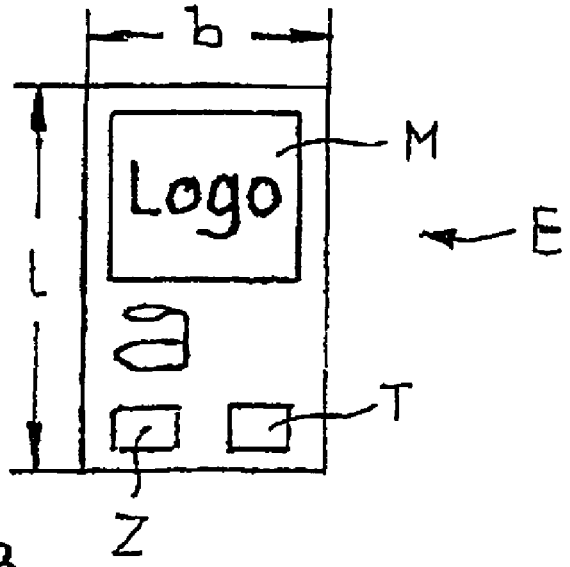
FIG. 3 shows a plan view of a further individual label.
Figure 4:
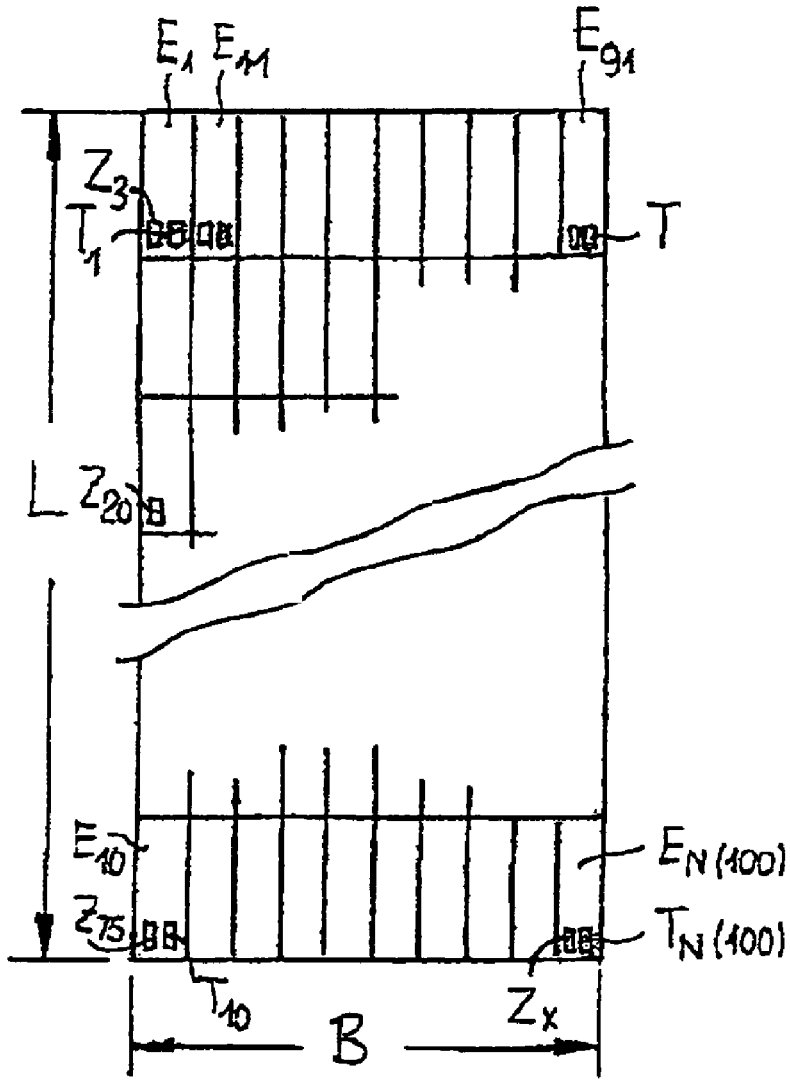
FIG. 4 shows a virtual label consisting of the individual labels of FIG. 3.

FIGS. 3 and 4 show a further label E with a pattern M and with a first pattern part T and a second pattern part Z which has a length l of, for example, 70 mm and a width b of, for example, 30 mm. The control program then, is then designed, for example, in such a way that 10 labels $E_1$ to $E_{10}$ are arranged so as to be distributed in a longitudinal row in the longitudinal direction of the cloth web W, and these are followed, over the width, by further rows with continuous numbering $E_{11}$ to $E_{20}$, $E_{21}$ to $E_{30}$, and so on and so forth, up until $E_N$, the virtual label V thus being formed, which has a length L and a width B. The width B of the virtual label V corresponds to a repeat width of the Jacquard weaving machine. If a label has a length of l=70 mm and width b=30 mm and 10 rows are arranged next to one another, then, in the case of a batch size of N=50,000, a virtual label with the length L=150 m and the width B=0.3 m is obtained. The length L of the virtual label V is expediently selected at most as large as the length of the cloth web capable of being wound on a cloth beam. The rows of labels may in each case be wound up into a roll in which the labels carry continuous numbering.

The second pattern part Z of the label of FIGS. 3 and 4 contains coded additional information (Z) which can be generated at the control means 23*c* of the pattern device 22 of FIG. 23*c*. The control means 23*c* contain a random generator which assigns a coded sign $Z_x$ for every label $E_1$ to $E_N$, in addition to the continuous number $T_1$ to $T_N$, as is indicated in FIG. 4, in order to give a product provided with such a label, for example, copyright protection, multi-theft security or the like.

Figure 5:
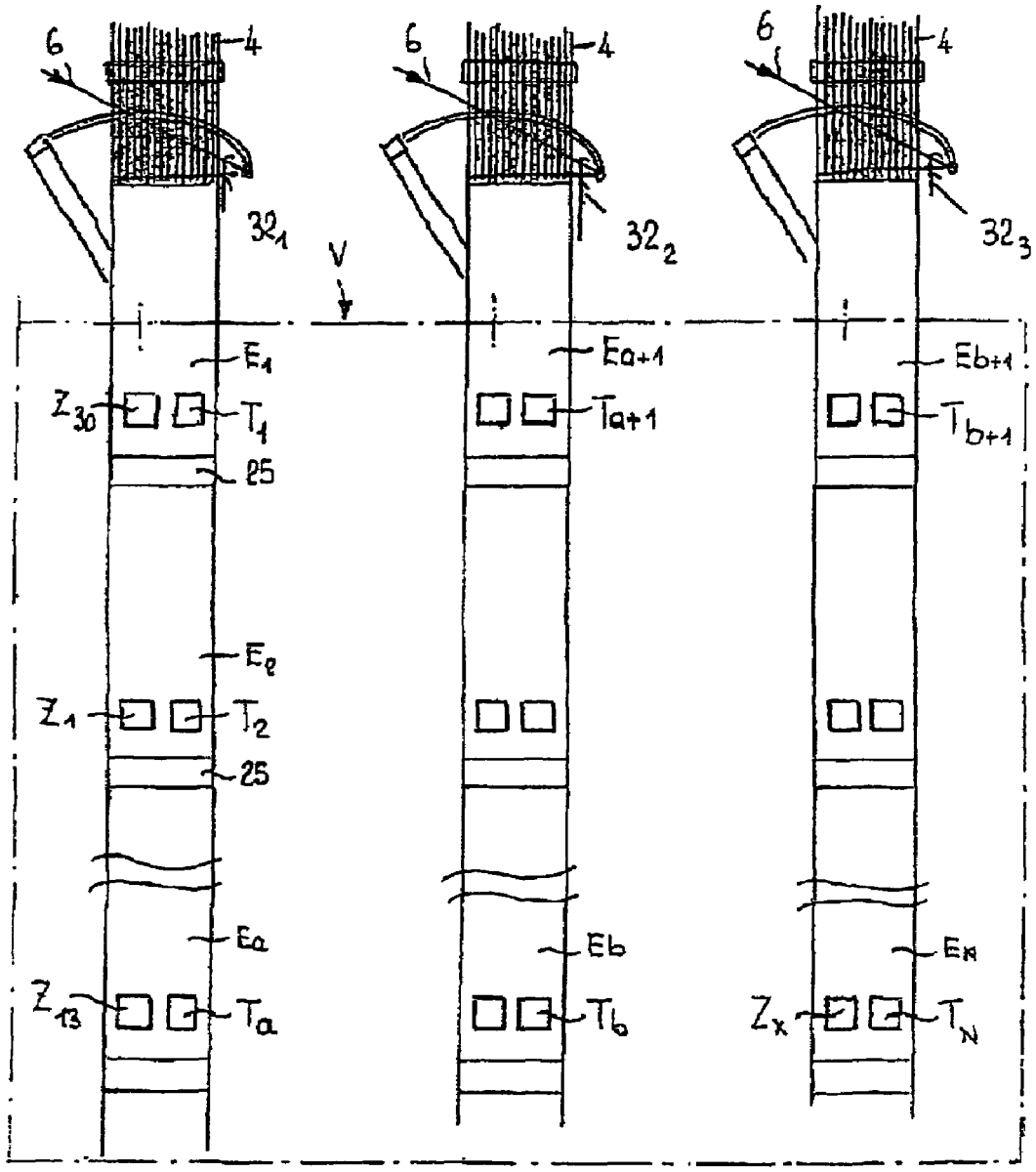
FIG. 5 shows a diagrammatic illustration of a three-section needle ribbon weaving machine.

FIG. 5 illustrates a further individual label V which is produced on a three-section needle ribbon weaving machine. The individual labels are in this case distributed to the individual weaving points $\mathbf{32}_1$, $\mathbf{32}_2$, $\mathbf{32}_3$. Thus, the labels $E_1$ to $E_a$ are generated at the first weaving point $\mathbf{32}_1$, the labels $E_{a+1}$ to $E_b$ at the weaving point $\mathbf{32}_2$, and the remaining labels $E_{b+1}$ to $E_N$ at the third weaving point $\mathbf{32}_3$, in each case strips are connected to one another in terms of content only by means of mutually coordinated numbering and arrangement of the pattern parts $T_1$ to $T_N$. Moreover, the labels have an additional coded pattern part $Z_x$.

According to the present method and by means of the present installation, for example, a customer can send the graphics of his label in Tif format to a pattern center, with an indication of the position of the pattern part, for example a numbering. This pattern center prepares, for the arrangement and shape of the pattern part and for the design and arrangement of the individual pattern part, a master program which is then sent back, for example in the form of a programmed diskette, to a customer, for example the weaver, in order to process it in a Jacquard weaving machine.

LIST OF REFERENCE SYMBOLS

E label
M pattern
T pattern part
V virtual label
W cloth web
Z pattern part (addition)
L length of the virtual label
B width of the virtual label
l length of the label
b width of the label
2 ground fabric

4 ground warp thread
6 ground weft thread
8 figure weft thread
10 Jacquard device
12 heddle
14 heddle eye
16 shed
18 control device
20 production counter
22 pattern device
22*a* design part
22*b* converter (design device)
23*a* CAD device
23*b* control means
23*c* control means
24 first severing device
25 intermediate zone
26 second severing device
28 thermal cutting element
30 scissors
32 weaving point

The invention claimed is:

1. A method for producing patterned textile labels, the labels ($E_1$ to $E_N$) being provided with a pattern (M) identical for all the labels and with pattern parts ($T_1$ to $T_N$, $Z_1$ to $Z_N$) different from one another by means of a production machine controlled by a pattern device (22), characterized in that a virtual label (V) consisting of N individual labels ($E_1$ to $E_N$) is produced, said individual labels being distributed over the width (B) and the length (L) of the virtual label (V) and having N individual pattern parts ($T_1$ to $T_N$, $Z_1$ to $Z_N$) that differ from one another, and virtual label (V) thus produced is subdivided into individual labels ($E_1$ to $E_N$).

2. The method as claimed in claim 1, characterized in that the width corresponds to a number of warp threads (4) used for a production machine.

3. The method as claimed in claim 1, characterized in that the length (L) of the virtual label (V) is selected according to the cloth web (W) which is capable of being wound on a winding beam of a production machine.

4. The method as claimed in claim 1, characterized in that the number N of labels (E) of the virtual label (V) is selected according to the number of labels capable of being packaged in a packaging unit.

5. The method as claimed in claim 1, characterized in that the labels ($E_1$ to $E_N$) are provided in each case with at least one second pattern part ($Z_1$ to ZN) which is different from label to label.

6. The method as claimed in claim 5, characterized in that a continuous numbering is selected for at least one individual pattern part ($T_1$ to $T_N$, $Z_1$ to $Z_N$) and is distributed continuously, preferably in the longitudinal direction of the virtual label (V), in rows lying next to one another.

7. The method as claimed in claim 5, characterized in that bar codes different from label to label are selected for at least one individual pattern part ($T_1$ to $T_N$, $Z_1$ to $Z_N$).

8. The method as claimed in claim 5, characterized in that counterfeit-proof additional codes which are different from label to label and are preferably generated by means of a random generator are selected for an individual pattern part $Z_1$ to $Z_N$.

9. The method as claimed in claim 5, characterized in that graphic figures which are different from label to label are selected for an individual pattern part ($T_1$ to $T_N$, $Z_1$ to $Z_N$).

10. The method as claimed in claim 1, characterized in that the virtual label (V) is provided at the start and at the end with identifying information.

11. The method as claimed in claim 1, characterized in that pattern-free intermediate zones (25) for subdividing the virtual label into, individual labels or label webs are arranged in the virtual label (V) between the individual labels in the longitudinal direction and/or in the width direction.

12. The method as claimed in claim 11, characterized in that the intermediate zones are formed by a pattern-free ground fabric part.

13. The method as claimed in claim 11, characterized in that the intermediate zones are formed in the longitudinal direction by fabric-free zones, in that the virtual label is produced in longitudinal strips distributed over the width.

14. The method as claimed in claim 1, characterized in that the virtual label (V) is first prepared in the design mode and is then converted by means of a converter (22*b*) into a pattern mode capable of being processed by the production machine.

15. The method as claimed in claim 14, characterized in that the individual pattern parts ($T_1$ to $T_N$, $Z_1$ to $Z_N$) are generated manually in the design mode.

16. The method as claimed in claim 14, characterized in that the individual pattern parts ($T_1$ to $T_N$, $Z_1$ to $Z_N$) are generated semiautomatically in the design mode.

17. The method as claimed in claim 14, characterized in that the individual pattern parts ($T_1$ to $T_N$, $Z_1$ to $Z_N$) are generated fully automatically in the design mode.

18. The method as claimed in claim 14, characterized in that a computer-controlled pattern device (22) with a CAD system (23*a*) having design software and with at least one control means (23*b*, 23*c*) for generating the individual pattern parts ($T_1$ to $T_N$, $Z_1$ to $Z_N$) is used for the design mode.

19. The method as claimed in claim 1, characterized in that the pattern device (22) is arranged independently of the production machine and carries out the data transfer to the production machine by means of a data line or preferably by means of a data carrier.

20. The method as claimed in claim 1, characterized in that the production machine used is a printing machine.

21. The method as claimed in claim 1, characterized in that the production machine used is a Jacquard weaving machine.

22. The method as claimed in claim 21, characterized in that the virtual label (V) is woven on a Jacquard broad-weaving machine without fabric-width repeat repetition.

23. The method as claimed in claim 21, characterized in that the virtual label (V) is produced on a multi-section Jacquard needle ribbon weaving machine without fabric-width repeat repetition.

24. The method as claimed in claim 1, characterized in that the virtual label (V) is subdivided at least in the longitudinal direction on the production machine, preferably by thermal cutting.

25. The method as claimed in claim 1, characterized in that the virtual label (V) is subdivided in the width direction on the production machine, preferably by thermal cutting.

26. The method as claimed in claim 1, characterized in that the subdivision of the virtual label (V) is carried out independently of the production machine.

27. The method as claimed in claims 1, characterized in that the virtual label (V) is produced on the production machine which has a production counter (20) for the individual labels which is preferably capable of being loaded with an instruction for the number of labels to be produced.

28. An installation for carrying out the method as claimed in claim 1, with a pattern device (22) and with a production machine, characterized in that the pattern device (22) has control means for generating a virtual label (V) which has N individual labels ($E_1$ to $E_N$) distributed over the width (B) and the length (L) of the virtual label and having N individual pattern parts ($T_1$ to $T_N$, $Z_1$ to $Z_N$) different from one another.

29. The installation as claimed in claim 28, characterized in that the pattern device (22) is arranged independently of the production machine.

30. The installation as claimed in claim 29, characterized in that the pattern device (22) has output means for generating a data carrier for data exchange with the production machine.

31. The installation as claimed in claim 28, characterized in that the production machine has a production counter (20) for detecting the number of individual or single labels produced.

32. The installation as claimed in claims 28, characterized in that the production machine is a printing machine.

33. The installation as claimed in claim 28, characterized in that the production machine is a Jacquard weaving machine.

34. The installation as claimed in claim 33, characterized in that the Jacquard weaving machine is a broad-weaving machine.

35. The installation as claimed in claim 33, characterized in that the Jacquard weaving machine is a multi-section needle ribbon weaving machine.

* * * * *